US005452561A

United States Patent [19]

Thompson et al.

[11] Patent Number: 5,452,561

[45] Date of Patent: Sep. 26, 1995

[54] PACKAGE BANDING MACHINE

[75] Inventors: Ralph F. Thompson; Charles E. Frost, both of Cincinnati, Ohio

[73] Assignee: Super Products Inc., Cincinnati, Ohio

[21] Appl. No.: 24,635

[22] Filed: Mar. 2, 1993

[51] Int. Cl.[6] ..... B65R 13/02

[52] U.S. Cl. ..... 53/399; 53/176; 53/202; 53/376.2; 53/590

[58] Field of Search ..... 53/176, 202, 209, 53/210, 220, 233, 376.2, 465, 590, 399

[56] References Cited

U.S. PATENT DOCUMENTS

| | | | |
|---|---|---|---|
| 1,824,390 | 9/1931 | Bronander | 53/202 |
| 2,685,771 | 8/1954 | Magnuson et al. | 53/590 X |
| 3,220,160 | 11/1965 | Roberts | 53/233 |
| 4,351,679 | 9/1982 | Dreher | 53/590 X |
| 4,663,914 | 5/1987 | Ganz | 53/590 X |
| 4,931,131 | 6/1990 | Thompson . | |

FOREIGN PATENT DOCUMENTS

| | | | |
|---|---|---|---|
| 978076 | 11/1975 | Canada | 53/209 |
| 2147082 | 3/1972 | Germany | 53/210 |
| 2109265 | 10/1972 | Germany | 53/233 |

*Primary Examiner*—Linda Johnson
*Attorney, Agent, or Firm*—Wood Herron & Evans

[57] ABSTRACT

A package banding machine for wrapping each of plural packages with a band. The machine includes a package conveyor for continuously moving successive packages in-line in a machine direction at a set line speed. A series of band transfer heads connected to a transfer head conveyor are provided for transferring separate package bands from a supply source into overlying proximity with each package's obverse face, the transfer head conveyor also moving at the set line speed. A band forming head is cooperatively associated with the band transfer head, the forming head functioning to deform each band around against opposed side faces of a package after the transfer head has positioned the band against the package's obverse face. The machine includes a first flap folder for folding one end of the package band against a reverse face of the package while the package is continuously moving in the machine direction, and also includes a second flap folder for folding the band's other end against the package's reverse face while the package is moving in the machine direction. Preferably the band is oriented generally parallel to the machine direction when the band is positioned against the package's obverse face so that the first flap folder can fold the band's one end in a counter-machine direction, and so that the second flap folder can fold the band's other end in the machine direction.

35 Claims, 6 Drawing Sheets

PACKAGE BANDING MACHINE

This invention relates to packaging machinery. More particularly, this invention relates to packaging machinery adapted to wrap a band around a package.

There are many steps in the manufacture and distribution of sausages, e.g., hot dogs, to the retail consumer. One area in which significant handling problems arise is in the packaging of hot dogs by the meat processor. A common packaging system currently in use involves the heat shrink wrapping of hot dogs in individual packages of, e.g., four or six hot dogs. The hot dogs are grouped together side by side with their longitudinal axes parallel one to the other, and that hot dog group then encased in a shrinkable wrap. It is common in the marketing of hot dogs that two such shrink wrapped hot dog packages be banded together so as to create a final package of, e.g., eight or twelve hot dogs. In this approach, two shrink wrapped hot dog packages abut together in face to face orientation so that a band can be wrapped therearound.

From a practical commercial standpoint, and in the packaging of hot dogs in the above mentioned fashion, it is desirable to provide packaging machinery by which such pairs of hot dog packages can be banded together with a band that wraps around all four faces of the combination package. This for the reason, of course, that the sales volume of hot dogs is huge, and it is quite desirable that such a banding step in the packaging process be accomplished on a continuous motion basis as efficiently as possible from both a time standpoint and a labor standpoint.

Accordingly, it has been one objective of this invention to provide an improved package banding machine in which a package can be wrapped with a band about its circumference without intervention of human labor.

It has been another objective of this invention to provide a package banding machine in which bands can be successively removed from a band supply source, transferred into wrapping proximity with a package, and thereafter wrapped around the package, in connection with plural such packages moving in-line in a machine direction continuously one after the other.

It has been a further objective of this invention to provide a workpiece handling system which makes use of a novel vacuum system that allows a workpiece, e.g., package bands to be transferred from a workpiece pickup station, e.g., a band supply source, to a workpiece release station, e.g., a package banding station.

In accord with these objectives, the package banding machine of this invention is particularly adapted to wrap a band around a product's package. The machine includes a package conveyor for moving plural in-line packages in a machine direction at a set line speed. A transfer head conveyor is provided, in preferred form, with a series of band transfer heads each of which is adapted to transfer a band from a supply source into overlying proximity with a package's obverse face on the package conveyor, the transfer head conveyor also moving at the set line speed. The package banding machine further includes a band forming head that cooperates with the band transfer head for deforming the band around against opposed side faces of the package, the band forming head also being connected with the transfer head conveyor and therefor also moving at the set line speed. A mechanical system also is provided which allows each of the transfer head and the forming head to reciprocate independently one of the other, each being reciprocable between a rest position out of banding relation with the package and a use position in banding relation with the package, the mechanical system preferably including a slider assembly to which the transfer head and the forming head are connected which allows both the transfer head and the forming head to move on a common motion path independently one of the other between their rest and use positions. Again in preferred form, a vacuum system is connected with each transfer head so that the bands are held to the transfer heads through use of a vacuum while the bands are being transferred from the supply source to the packages on the package conveyor. The machine also includes a first flap folder for folding one end of the band against a reverse face of the package while the package is moving in the machine direction, and a second flap folder for folding the other end of the package band against the package's reverse face while the package is moving in the machine direction. Preferably the band is oriented generally parallel to the machine direction when the band is initially positioned against the package's obverse face. And when this situation obtains, the first flap folder folds each band's one end in a counter-machine direction and the second flap folder folds each band's other end in the machine direction. The first flap folder is preferably stationary during band folding use so that each band's one end is folded in the counter machine direction as the package is moved in the machine direction by the package conveyor, and the second flap folder is preferably movable during band end folding use in the machine direction at a speed greater than the set line speed in order to fold each band's other end in the machine direction as the package is moved in the machine direction by the package conveyor.

Other objectives and advantages of this invention will be more apparent from the following detailed description taken in conjunction with the drawings in which.

Figure 3:
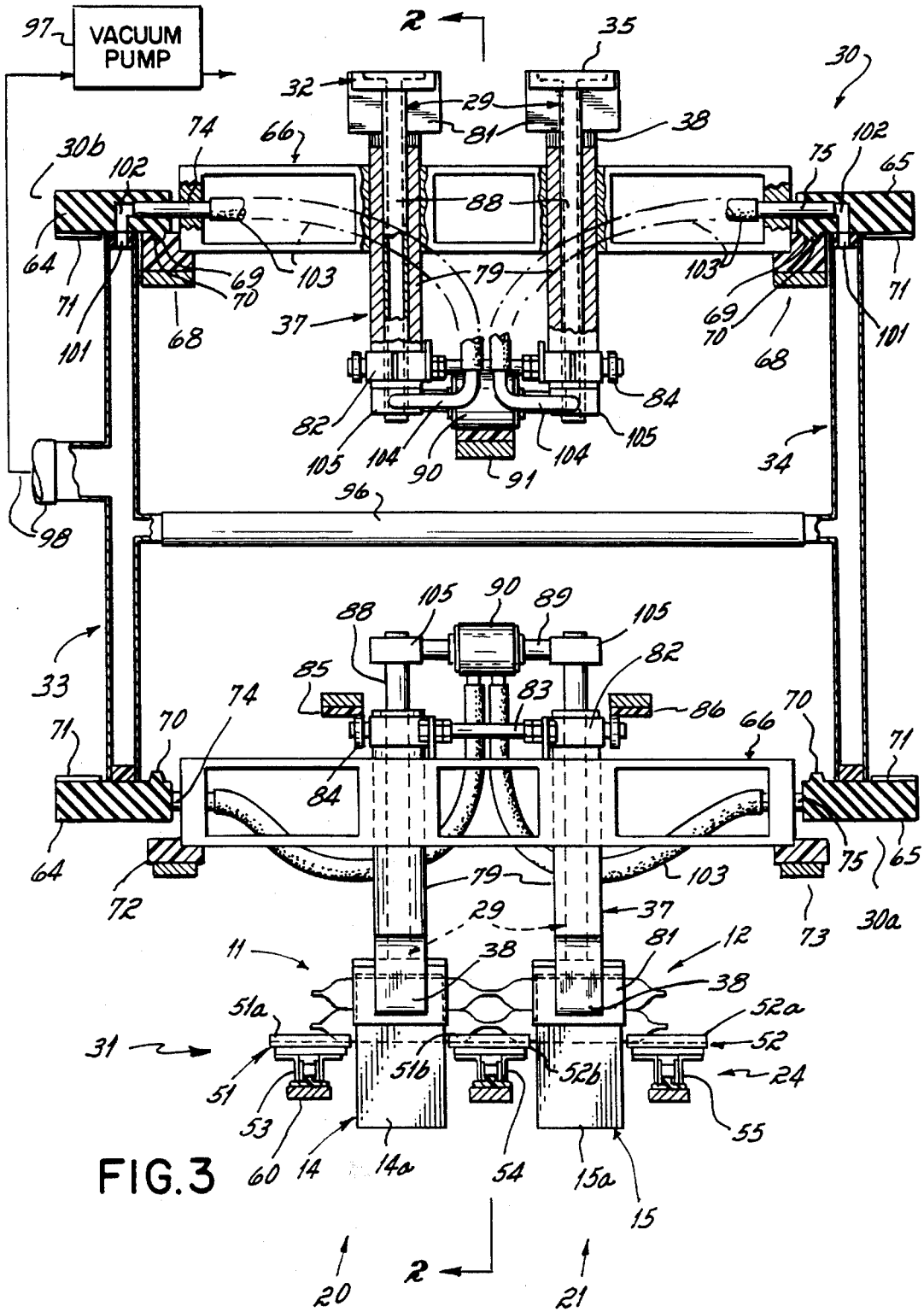
FIG. 3 is a cross-sectional view taken along lines 3—3 of FIG. 2, this view showing the machine's vacuum system and two connected product packages each of which is partially banded.
Figure 4:
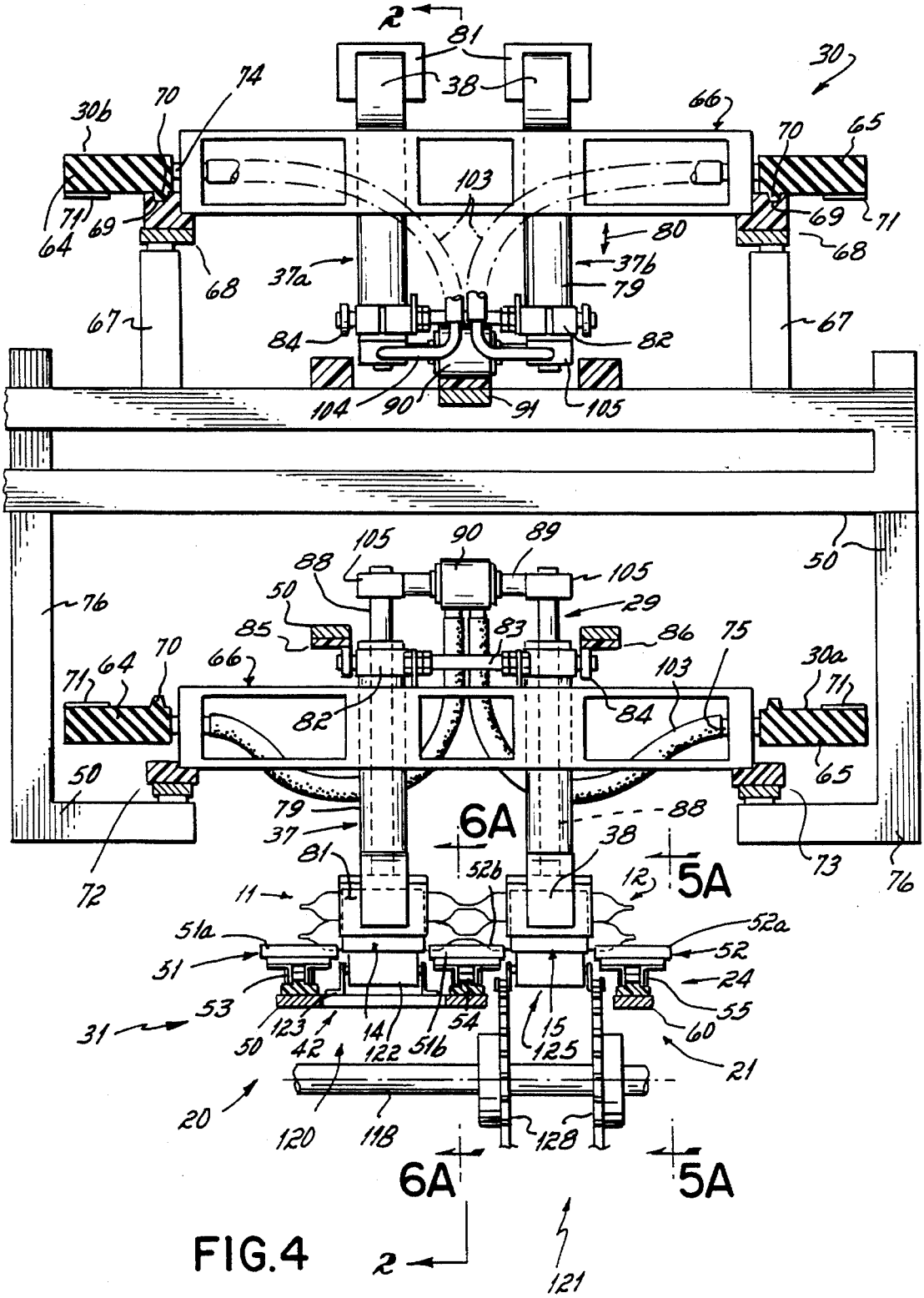
FIG. 4 is a cross-sectional view taken along lines 4—4 of FIG. 2, this view showing two connected product packages each of which is fully banded.
Figures 5A, 5B, 5C, 5D:
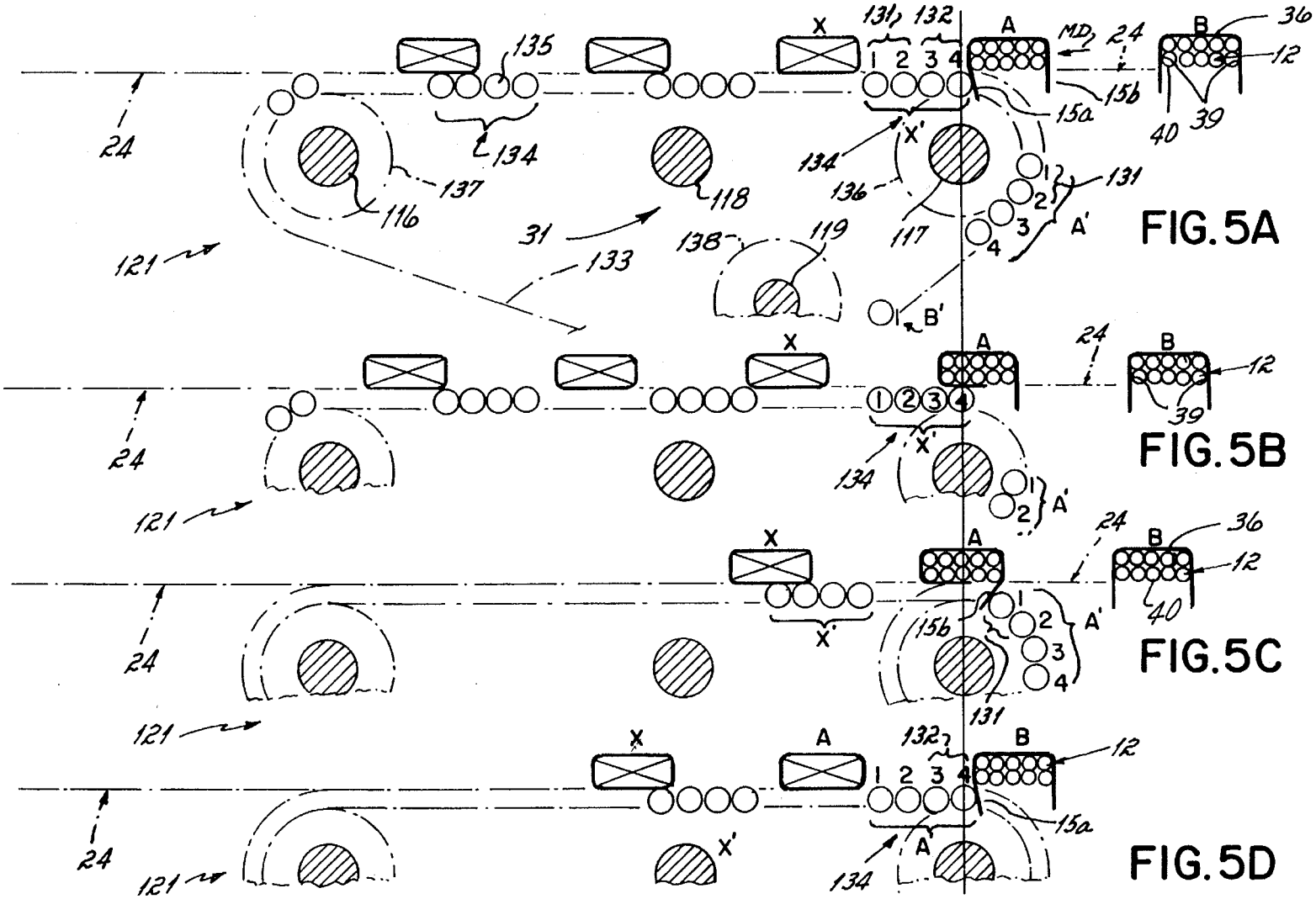
Figures 6A, 6B, 6C, 6D:
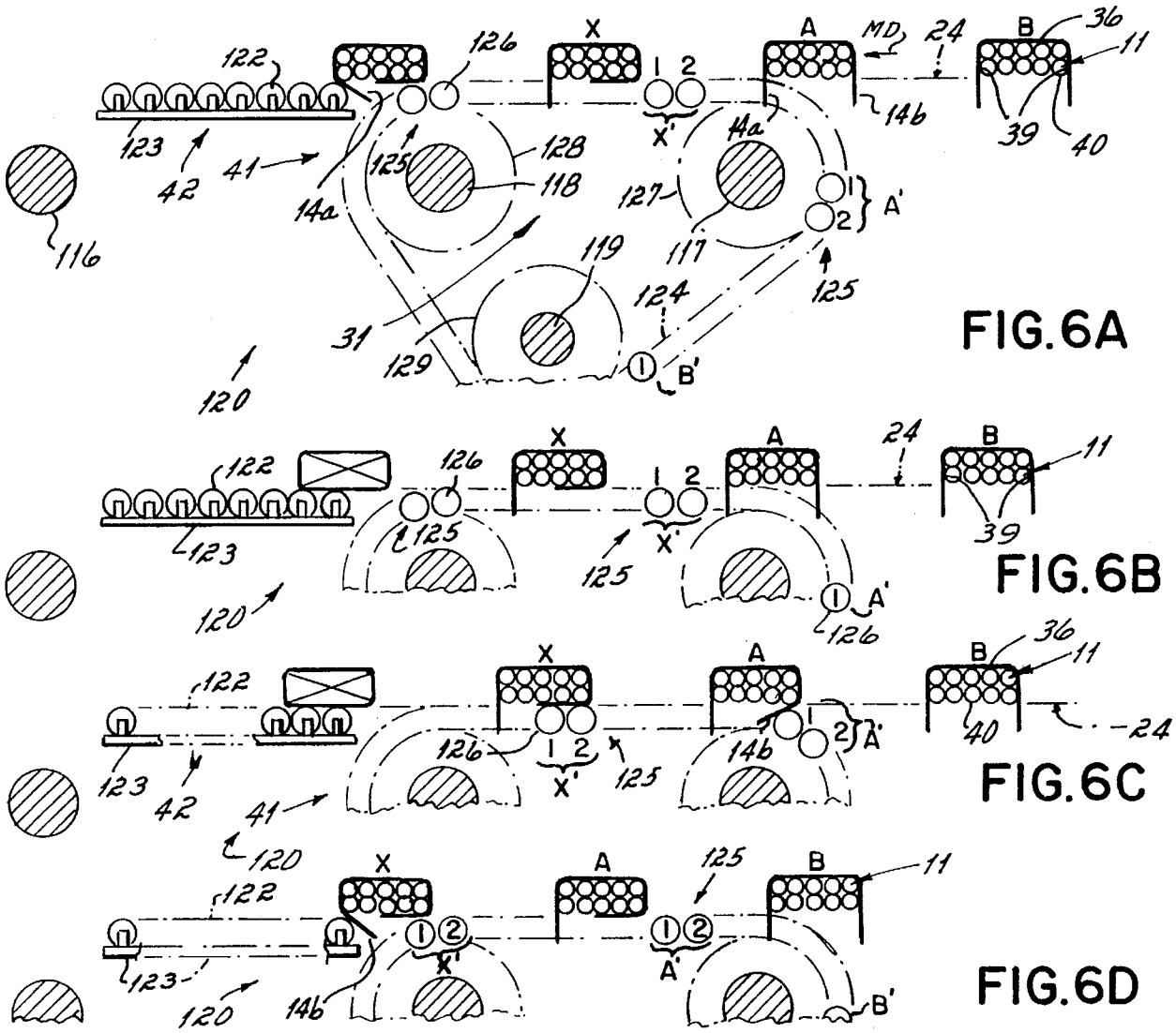

FIG. 5 is a cross-sectional view taken along line 5A—5A of FIG. 4, illustrates the start of a preceding stop cycle in the band flap folding sequence when folding a band's flaps around a product package, and illustrates the band flap folding sequence where the band's front flap is folded first (FIGS. 5A–5D being directed to the right hand package banding line of the package banding machine as shown in FIGS. 3 and 4);

FIG. 5B is similar to FIG. 5A but illustrates the band flap folding sequence at the end of the stop cycle;

FIG. 5C is similar to FIGS. 5A and 5B but illustrates an intermediate step in the band flap folding sequence;

FIG. 5D is similar to FIGS. 5A–5C but illustrates the start position of a succeeding stop cycle in the band flap folding sequence;

FIG. 6A is a cross-sectional view taken along lines 6A—6A of FIG. 4, and illustrates the start of a preceding stop cycle in the band flap folding sequence, and illustrates the band flap folding sequence where the band's rear flap is folded first (FIGS. 6A–6D being directed to the left hand package banding line of the package banding machine as shown in FIGS. 3 and 4);

FIG. 6B is similar to FIG. 6A, and illustrates the band flap folding sequence at the end of the stop cycle;

FIG. 6C is similar to FIGS. 6A and 6B but illustrates an intermediate step in the band flap folding sequence; and FIG. 6D is similar to FIGS. 6A–6C but illustrates the start position of a succeeding stop cycle in the band flap folding sequence.

GENERAL DESCRIPTION

Figure 1:
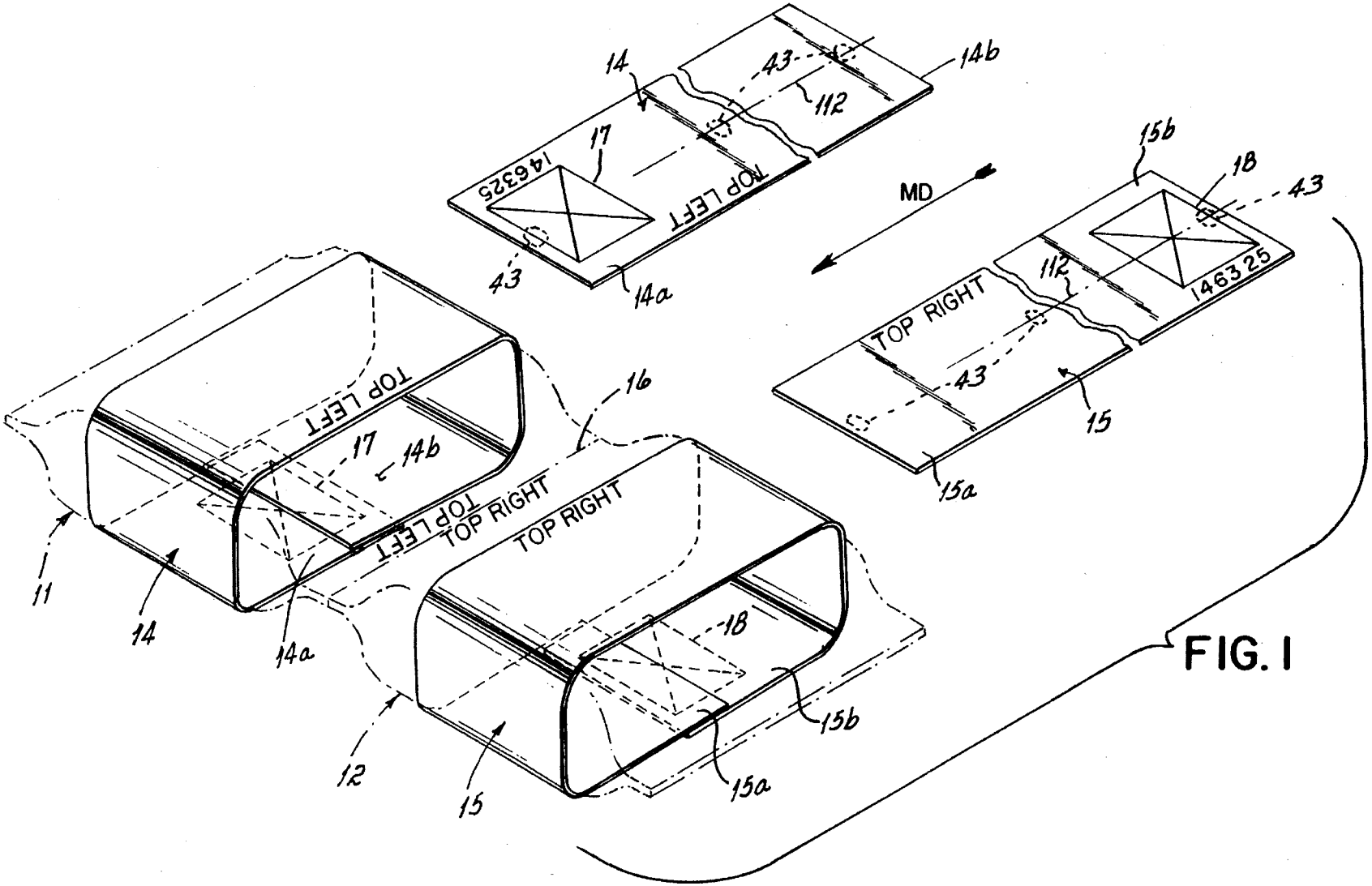
FIG. 1 is a top perspective view illustrating the wrapping each of two attached product packages with a band in accord with the principles of this invention.
Figure 2:
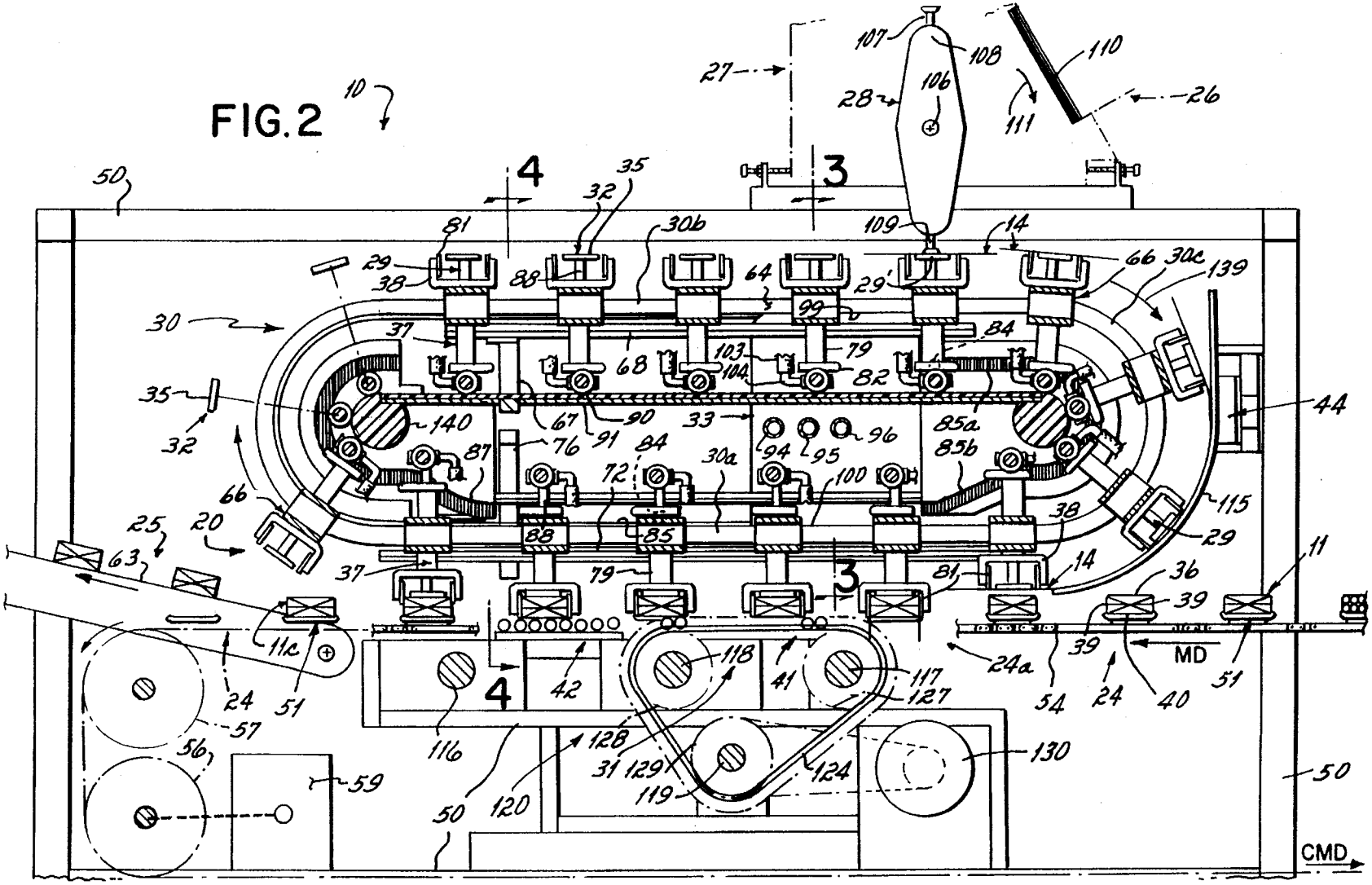
FIG. 2 is a longitudinal cross elevational view illustrating a package banding machine in accord with the principles of this invention.

A package banding machine 10 in accord with the principles of this invention is particularly illustrated in FIGS. 2–4. The package banding machine 10 is structured to simultaneously wrap two product packages 11, 12, e.g., two sealed packages of hot dogs, with separate bands 14, 15. The product packages 11, 12 are connected one with the other along a machine direction (MD) cut line 16, see FIG. 1, during the banding step. After banding, the combination banded packages 11, 12 are separated one from the other simply by slicing them apart along the cut line 16.

Each pair of connected product packages 11, 12, prior to being banded, is provided with printed indicia (e.g., TOP LEFT for left package 11 and TOP RIGHT for right package 12) adjacent the cut line 16, this package printed indicia being printed in mirror relation on the packages 11, 12 relative one package to the other, see FIG. 1. The bands 14, 15 also have printed indicia (e.g., TOP LEFT and a bar code 17 for band 14 and TOP RIGHT and a bar code 18 for band 15). And these bands 14, 15 must be wrapped in mirror relation one to the other around the connected product packages 11, 12 so that a user of either package 11 or 12, after the packages are separated one from the other, can read both the package's printed indicia and the band's printed indicia from the same visual orientation, see FIG. 1. Importantly in this regard, it is clear from FIG. 1 that with the right hand package 12 the band's front or leading flap **15*a* must be folded first so that when that band's rear flap 15*b* is folded over that band's entire UPC bar code 18 will be visible to a bar code reader. But with the left hand package 11 (and because of the mirror relationship of the printed indicia on the left hand package 11 and the left hand band 14 relative to the printed indicia on the right hand package 12 and the right hand band 15) the band's trailing flap 14*b* must be folded under the package before the band's leading flap 14*a* is folded onto the package's bottom face. Again, this for the reason that the band's end flaps 14*a*, 14*b* for left hand package 11 must be folded in overlapping relation relative one to the other so that the entire UPC bar code 18 on the band is visible to a bar code reader when the package 11** is wrapped with the band.

The package banding machine 10 of this invention is comprised of two side-by-side parallel package processing lines 20, 21 the line 20 being adapted to band the left hand package 11 of each connected package pair 11, 12 and the line 21 being adapted to band the right hand package 12 of each package pair, see FIGS. 2–4. The overall configuration of the package banding machine 10 is particularly illustrated in FIG. 2, and the FIG. 2 system is duplicated for each of the processing lines 20, 21 with exceptions as noted below. The two connected processing lines 20, 21 are particularly illustrated in FIGS. 3 and 4 where the left hand processing line 20 is clearly shown as connected with the right hand processing line 21. FIG. 2, in effect, is a combination cross-sectional view taken along line 2—2 of FIG. 3 and line 2A—2A of FIG. 4, and particularly illustrates the left hand processing line 20. Thus, the package banding machine 10 operates to wrap bands 14, 15 simultaneously around packages 11, 12 of each connected package combination shown in FIG. 1 through use of the parallel processing lines 20, 21.

The package banding machine 10, as illustrated in FIG. 2, is adopted to process a series of combination packages 11, 12 that are fed into the package banding machine by a package conveyor 24. Once banded, the combination packages 11, 12 are removed from the package banding machine by an outfeed conveyor 25 for subsequent boxing and shipment.

A band 14, 15 is wrapped around each individual product package 11, 12 by the package banding machine. The bands 14, 15 are held in a band hopper 26 at a band supply source 27, and are fed by a transfer arm 28 one at a time to successive band transfer heads 29. There are a series of band transfer heads 29 connected to a transfer head conveyor 30, each band transfer head being adapted to receive and hold one band 14 or 15 so as to allow transfer of the band from the band supply source 27 to the machine's banding station 31 where it can be wrapped with a non-banded product feed package 11 or 12. Each band transfer head 29 is vacuum operated in that the head's pick up plate 32 is connected to a vacuum chamber 33 or 34 so that the band 14 or 15 is held on the pick up plate's surface 35 by vacuum as it is translated between the band supply source 27 and the machine's banding station 31.

With the band transfer head 29 overlying a product package entering the machine's banding station 31 (see FIG. 2), that head is caused to extend so that the centrally located package band 14 or 15 on the head is centrally located flush against the top of the obverse or top face 36 of the package 11 or 12. A forming head 37 which is mounted in slideable relation to the transfer head 29, and which presents an inverted U-shaped head 38, is simultaneously caused to move from a retracted position where same is not in operational relation with the package 11 or 12 to a use position where the leading **14*a* or 15*a* and trailing 14*b* or 15*b* flaps of the band 14 or 15 are simultaneously folded down over the side edges 39 of the package 11 or 12**.

Subsequently, and relative to the left hand processing line 20 shown in FIGS. 2 and 6, first the band's rear flap **14*b* is folded under the package 11 against the package's reverse face 40, and then the band's front flap 14*a* is folded under the package's reverse face, thereby wrapping the band 14 entirely around the package as the package and the band pass the left hand line's first flap folder 41 and second flap folder mechanism 42 in the machine's banding station. With glue spots 43 having been previously deposited at the approximate center, and on the leading end flap 14*a* and trailing end flap 14*b* of the band 14 at glue station 44, the wrapping around the package of the band results in permanent adherence of the band to the package. In this regard, and relative to the left hand processing line 20 only, the leading 14*a* and trailing 14*b* flaps of each package band are folded in the counter-machine direction (CMD) and machine direction (MD), respectively, by the second flap folder 42 which is a stationary flap folder carriage that cooperates with the continuous motion package conveyor, and by the first flap folder mechanism 41 which is an intermittent motion flap folder conveyor that also cooperates with the continuous motion package conveyor 24**.

DETAILED DESCRIPTION

Primary components of the package banding machine 10 of this invention are, as previously noted, the package conveyor 24, the outfeed conveyor 25, the transfer head conveyor 30, the flap folder mechanism (41, 42 for the left hand line 20 and flap folder to be described for the right hand line), the band supply source 27 and the glue station 44. All these components are carried on a machine frame 50.

The package conveyor 24, which is illustrated in FIGS. 2 and 3, moves successive connected package pairs 11, 12 in a machine direction (MD) at a set line speed. The package conveyor 24 is provided with successive double trays 51, 52 fixed on conveyor chains 53, 54 and 55 trained around upstream idler sprockets (not shown) and downstream drive 56 and idler 57 sprockets. The drive sprocket 56 being suitably connected with a conventional speed adjustable drive mechanism 59. The package double tray 51, 52 are spaced one from the other on the package conveyor 24, and are sized to receive the combination packages 11, 12 shown in FIG. 1. The package conveyor 24, as particularly shown in FIG. 3, thereby defines a left hand line 20 and a right hand line 21 which are simultaneously driven by left hand 53, center 54 and right hand 55 conveyor chains that ride over support rails 60. Each double package tray 51, 52 is comprised of a left hand tray 51 with tray sections 51*a*, 51*b* and a right hand tray 52 with tray sections 52*a*, 52*b*, each double tray being partially carried by the left hand 53, center 54 and right hand 55 chains. Note this tray 51, 52 structure allows package 11 or 12 of each combination package 11, 12 to be supported only at its ends as shown in FIG. 3, i.e., neither package 11 or 12 is supported in its middle. The reason for this is to allow the band flap ends 14*a*, 14*b* and 15*a* 15*b* to be folded down around the side edges 39 of the left 11 and right 12 packages by the band forming head 37 as shown in FIG. 3, as well as to allow the flap folder mechanism (41, 42 for the left hand line 20) to fold the leading and trailing flaps against each successive package's reverse surface 40 as shown in FIG. 4 without hindrance by the package conveyor's trays 51, 52.

The package conveyor 24 cooperates with an outfeed conveyor 25 as shown in FIG. 2. The outfeed conveyor 25 is comprised of two separate parallel belt conveyors 63 (only one shown) angled upwardly relative to the package conveyor 24, the left hand outfeed conveyor 63 being located between the package conveyor's left hand chain 53 and center chain 54, and with the right hand outfeed conveyor (not shown) being located between the package conveyor's right hand chain 55 and center chain 54. This relation allows the outfeed conveyor 63, to take off the banded packages 11, 12 from the end of the package conveyor in a machine direction (MD) while allowing the package conveyor's trays 51, 52 to cycle back around the package conveyor's lower run 24*b* to receive additional packages 11, 12.

The transfer head conveyor 30 is a closed loop conveyor with its operational run 30*a* located above and parallel to the operational run 24*a* of the package conveyor. The transfer head conveyor 30 is also driven by the speed adjustable drive 59 so that the line speed of the transfer head conveyor in the machine direction (MD) is identical to the line speed of the package conveyor 24 in the machine direction (MD) in the banding station 31 area of the machine 10. The transfer head conveyor 30 is comprised of a left hand timing belt 64 and a right hand timing belt 65 connected together in fixed relation by a series of head frames 66. Each of the left hand 64 and right hand 65 timing belts includes timing teeth 71 on the inner face that mesh with the conventional timing drive (not shown) previously mentioned, and is supported at spaced locations along its length by fixed posts 67 that are mounted to and part of the machine frame 50. The top of each post 67 is provided with a conveyor support rail 68 for the conveyor's upper run 30*b* which includes a groove 69 that mates with a rib 70 on the associated timing belt 64, 65 so as to maintain the left hand and right hand transfer head conveyors 30 in alignment with a vacuum system 33, 34 described in detail below. The lower run 30*a* of the transfer head conveyor 30 is supported by the conveyor's head frames 66 which ride over left hand 72 and right hand 73 lower rails fixed to brackets 76 which are part of the machine frame 50. As mentioned previously, the transfer head conveyor 30 for the left hand package line 20 is physically connected in fixed relation to the transfer head conveyor for the right hand package line 21 by the series of head frames 66 which connect the left 64 and right 65 timing belts as at 74, 75 at the inside edges thereof.

A left hand 37*a* and an identical right hand 37*b* band forming head, are provided to service left hand 20 and right hand 21 package banding lines respectively, is mounted to each head frame 66. Each band forming head 37 is comprised of a hollow forming head shaft 79 that is slideably mounted in the head frame 66 so as to reciprocate (as shown by arrow 80) between a retracted position (see the location of the band forming heads 37 in the upper run 30*b* of the transfer head conveyor 30 shown in FIGS. 2–4) and an extended or folding position (see the position of the band forming head shown in the lower run 30*a* of the transfer head conveyor in FIGS. 2–4). Each band forming head 37 includes the inverted U-shaped forming head 38, and teflon slide plates 81 mounted to the leading and trailing fingers of that forming head 38. Each of the left hand 37*a* and right hand 37*b* forming heads also includes a fixed clamp 82 located opposite the head 38 and secured to the shaft 79, these clamps being connected together by a tie rod 83 so that both forming heads 37*a*, 37*b* will not rotate with respect to each other and so that they reciprocate up and down relative to the head frame 66 in tandem. Each forming head 37 also mounts a follower roller 84 on the fixed clamp 82. The follower rollers 84 for each forming head 37*a*, 37*b* cooperates with a left hand forming head follower, or guide track 85, and a right hand forming head follower track 86, fixed in position within the banding station 31. These tracks lead to left and right side outfeed sections 87, all of these sections 85, 86 and 87 being fixed in position to the machine frame 50, and all cooperating with the follower rollers 84 on the forming heads 37 in a manner described below.

A left hand band transfer head 29 is connected with the left hand band forming head 37*a*, and an identical right hand band transfer head 29 is connected with the right hand band forming head 37*b*, on each head frame 66, see FIGS. 3 and 4. In this regard, the left hand band transfer head 29, as shown in FIGS. 2 and 3, is comprised of a hollow vacuum head shaft 88 that is slideably mounted or carried in the hollow forming head shaft 79. The vacuum head plate 32 with vacuum orifice (not shown) on the exposed face thereof is fixed to the bottom end of the hollow vacuum head shaft 88. This hollow vacuum head shaft 88 and hollow forming head shaft 79 relation comprises a slider assembly to which both the transfer head 29 and the forming head 37 are connected, the slider assembly allowing both the transfer head and the forming head to reciprocate as shown by arrow 80 on a common motion path or center line between rest and use positions. The left and right hand transfer heads 29 connected to each head frame 66 are also connected one to the other by a roller shaft 89 that mounts follower roller 90. This structural relation ensures that both transfer heads 29, 29 move in tandem between a retracted or rest position shown in the upper run 30*b* of the transfer head conveyor 30 in all of FIGS. 2–4 and an extended or use position illustrated in the lower run 30*a* of the transfer head conveyor in all of FIGS. 2–4. The follower roller 90 cooperates with a transfer head follower, or guide track 91 under the upper run 30*b* of the transfer head conveyor 30 as shown in FIG. 2 to hold the transfer heads 29 and the forming heads 37 in the retracted position, the transfer heads simply falling by gravity into the use position as shown in FIG. 2 when they pass out the lower run 30*a* of the transfer conveyor 30. The transfer heads 29, of course, cooperate with the transfer arm 28 of the band supply source 27 to pick up bands 14, 15 one at a time from the supply source as previously explained, and as shown in FIG. 2.

A vacuum system is connected with the transfer head conveyor 30 at the upstream end 30*c* of that conveyor. The vacuum system includes a left 33 and right 34 hand vacuum chambers, as shown in FIGS. 2 and 3, that cooperate with the transfer head conveyors 30 for the left hand 20 and the right hand 21 package banding lines. The vacuum chambers 33, 34 are each connected one with the other across the machine frame 10 simply by vacuum chamber connector lines 94–96. The left hand vacuum chamber 33 is connected with a vacuum pump 97 by a plurality of exhaust lines one of which is shown at 98. There is novel porting structure which interconnects each vacuum chamber 33, 34 with its associated left and right hand band transfer heads 29. Each vacuum chamber 33, 34 is closed along its entire periphery except between approximately points 99 and 100, see FIG. 2. Between these points 99, 100, each vacuum chamber 33, 34 presents a continuously open mouth 101 that is sealed only by the underside of a transfer head conveyor belt 64 or 65, see FIGS. 3 and 4. Note particularly each transfer head conveyor belt 64, 65 is provided with a port 102 through it at that location where a head frame 66 is connected to it by hollow pin 74 or 75. In other words, port 102 is defined in the underside of each conveyor belt 64, 65 that communicates with the vacuum chamber 33, 34, and that port also communicates with a flexible vacuum hose 103 fixed to the inner edge of conveyor belt 64 or 65 by hollow pin 74 or 75. Each flexible vacuum hose 103 in turn is connected to rigid vacuum line 104 fixed to a ported clamp 105 at the inner end of the hollow transfer head shaft 88. The clamps 105 also mounts the shaft 89 for roller 90. The porting (not shown in detail) in the inner end of the hollow transfer head shaft 88 (with that hollow shaft being sealed at its inner end) ensures that vacuum is presented at the vacuum head plate 35 for pickup and transfer of the bands 14 or 15 by the band transfer heads 29.

The transfer head conveyor 30 cooperates with the band supply source 27 and the glue station 44. The band supply source 27, which may be of any common structure known to the prior art and by itself forms no part of this invention, includes the band hopper 26 and the transfer arm 28. The transfer arm 28 rotates on axis 106, and is provided with a vacuum pickup cup 107 at each end 108, 109. Each vacuum pickup cup 107 cooperates to withdraw a band 14, 15 from the bottom of the band stack 110 in the band hopper 26, and then pivot in the direction shown by motion arrow 111 until it is taken off that pickup hand by a band transfer head 29 as shown at transfer head 29'. Note, as shown in FIG. 2, the band 14 or 15 is oriented on the band transfer head 29 so that its longitudinal axis 112 (FIG. 1) is parallel to the machine direction (MD) of the transfer head conveyor 30 and package conveyor 24, and so that it is held in place on the transfer head plate 35 substantially equally intermediate the leading and trailing ends of the band, thereby providing a leading end flap 14*a*, 15*a* and a trailing end flap 14*b*, 15*b* to each band 14 or 15 carried by the band transfer heads relative to the machine direction (MD) in which the transfer head conveyor moves.

The glue station 44, which is shown schematically also in FIG. 2, is of any type hot melt glue mechanism known to the prior art, and so the glue station per se forms no part of this invention. As a band 14 or 15 passes the glue station 44, it is provided with at least one glue dot 43 on its leading end flap 14*a* or 15*a*, at least one glue dot intermediate its ends and at least one glue dot on its trailing end flap 14*b* or 15*b*, so as to ensure adherence of the band to the package 11 or 12 after it has been wrapped around the package. Note particularly there is provided guide rails 115 between the glue station 44 and the in-feed section of the banding station 31 to ensure that each band's flaps 14*a*, *b* and 15*a*, *b* do not get bent out of shape as they are moved by the transfer head conveyor 30 between the glue station 44 and the in-feed section of the banding station 31.

The left hand flap folder mechanism 120 by which the front 14*a*, 15*a* and rear 14*b*, 15*b* end flaps of each band 14, 15 are folded onto each package's reverse or under face 40 is different for the left hand processing line 20 versus a right hand flap folder mechanism 121 for the right hand processing line 21. The flap folder mechanism 120 for the left hand processing line 20 is illustrated in FIGS. 2 and 6. And the flap folder mechanism 121 for the right hand processing line 21 is illustrated in FIG. 5.

With regard to the flap folder mechanism 120 in the left hand package processing line 20, and as shown in FIG. 1, the rear flap 14*b* of the band 14 must be folded against the package's reverse side 40 first so that the leading flap 14*a* of the band can be folded on top of same. As mentioned above, the flap folder mechanism 120 to accomplish this trailing flap 14*b* first/leading flap 14*a* second folding approach is illustrated in FIGS. 2 and 6 as mentioned. The flap folder mechanism 120 includes the first flap folder 41 for folding the trailing end 14*b* of the band 14 against the package's reverse face 40 while the package is moving continuously in the machine direction (MD) as carried by the package conveyor 24. The flap folder mechanism 120 also includes the second flap folder 42 for folding the leading end 14*a* of the band 14 against the package's reverse face 40 also while the package is moving in the machine direction MD. In this regard, the second flap folder 42, which is located downstream of the second flap folder 41 as shown in FIGS. 2 and 6, is comprised of a series (eight being shown) of stationary rollers 122 mounted between rails 123 to form a roller carriage that is fixed to the machine frame 50. These stationary rollers 122 serve to fold the band's leading end flap 14*a* under the package as shown in FIGS. 6A–6D as the package 11 passes thereover. The first flap folder 41 is comprised of a flap folder conveyor 124 that includes a plural pairs 125 of rollers 126 spaced along its length, each roller pair 125 constituting a roller carriage. The flap folder conveyor 124, which is trained around sprockets 127–129 carried by shafts 117–119 respectively, is an intermittent motion conveyor that sequentially operates with a stop cycle followed by a fast advance cycle. The conveyor 124 is connected with a standard servo-drive 130 (FIG. 2) that controls the time length of the stop cycle and the fast advance cycle, and that controls the machine direction MD line speed of the fast advance cycle, as shown in FIGS. 6A and 6D. In other words, the flap folder conveyor 124 is adapted to remain stopped for a set cycle time period as the package conveyor 24 continues to run at its set line speed, and is then adapted to cycle forward at an intermittent motion line speed significantly greater than the package conveyor's set line speed for a set cycle time period, all in order to fold under each band's trailing flap 14*b*. The operational sequence for the flap folder mechanism 120 on the band's leading 14*a* and trailing 14*b* flaps is described in greater detail below.

The flap folder mechanism 121 for the right hand package processing line 21 of the package banding machine 10 is shown in FIGS. 5A–5D. In this right hand flap folding mechanism 121, the function of a first flap folder 131 and a second flap folder 132 are integrated into a single flap folder conveyor 133 that is driven by servo 130 so that it also operates on intermittent motion with the same stop cycle and fast advance cycle times, and the same fast advance line speed, as the left hand intermittent motion conveyor 124. The flap folder conveyor 133 is trained around sprockets 136–138, the sprockets 136 and 138 are carried by shafts 117 and 119 and the sprocket 137 is carried by a shaft 116. This flap folder conveyor 133 for the right hand processing line 21 is comprised of a series of groups 134 of four rollers 135 apiece, each roller group being spaced one from the other along the conveyor. The roller pair 1, 2 of each roller group 134 constitutes the roller carriage of the first flap folder 131 and functions to fold the band's trailing flap 15*b*. The roller pair 3, 4 of each roller group constitutes the roller carriage of the second flap folder 132, and functions to fold the band's leading flap 15*a*. This single flap folder conveyor 133 functions to fold under each band's leading flap 15*a* first, and then fold under each band's trailing flap 15*b* second, all the while the package conveyor 24 is continuously moving the packages 12 through the package banding machine 10. The detail of the operational sequence of the folding of the band's flaps 15*a*, 15*b*, as shown in FIGS. 5A–5D, is described in greater detail below.

Both the left hand flap folder mechanism 120 and the right hand flap folder mechanism 121 are connected to the machine frame 50 in fixed position relative to the location of the package conveyor 24.

OPERATION

The package banding machine 10 in accord with the principles of this invention operates to band two identical packages 11, 12 connected one to the other along a severable machine direction cut line 16. These packages 11, 12 may be provided with printed indicia (e.g., TOP LEFT and TOP RIGHT, respectively) in mirror relation relative one to the other. Thus, printed bands 14, 15 to be wrapped around each individual package 11, 12 of the two package combination must be wrapped around in mirror relation one to the other too, see FIG. 1. In this regard, the printed indicia (e.g., TOP LEFT) on the left hand package 11 must be readable from the same visual orientation as the printed indicia (e.g., TOP LEFT) on the left hand band 14 once the band is wrapped around that package 11, and similarly the printed indicia (e.g., TOP RIGHT) on the right hand package 12 must be readable from the same visual orientation as the printed indicia (e.g., TOP RIGHT) on the right hand band 15 once the right hand band is wrapped around that package 12. Furthermore, and importantly, the leading end 14*a* of the left hand band 14 must overlay the trailing end 14*b* of the left hand band when the left hand band is wrapped around the left hand package 11, but the trailing end 15*b* of the right hand band 15 must overlay the leading end 15*a* of the right hand band when the right hand band is wrapped around the right hand package 12, all so that the UPC bar codes 17, 18 on the respective bands 14, 15 can be read in their entirety by a suitable bar code reader, see FIG. 1. The package banding machine 10 of this invention, and the method by which the left hand band 14 and right hand band 15 are wrapped around the left hand package 11 and right hand package 12, respectively, allows these objectives to be achieved.

The package banding machine 10, as previously noted herein, includes a left hand package processing line 20 and a right hand package processing line 21, as illustrated in FIGS. 3 and 4. The left hand line 20 processes packages and bands as illustrated by the left hand package 11 and band 14 of the two package 11, 12 combination shown in FIG. 1, and the right hand line 21 processes packages and bands as illustrated by the right hand package 12 and band 15 of the two package combination shown in FIG. 1. The band flap folding mechanisms 120, 121 for the package banding machine 10, however, are different from structural as well as from operational standpoints between the left hand line 20 and the right hand line 21. Other than the difference in folding the band flaps 14*a*, *b* and 15*a*, *b*, however, the operation sequence of the package banding machine 10 is the same for both the left hand processing line 20 and the right hand processing line 21. Accordingly, the operation of the package banding machine 10 herein is described primarily with respect to the left hand line 20 which is illustrated particularly in FIGS. 2–3 and 6, it being understood that the operation of the right hand line 21 is the same as the left hand line except with respect to the band flap folding mechanism 21 as shown in FIGS. 5A–5D.

The operation of the package banding machine 10 will be described by following the wrapping of a single package 11 from beginning to end. In this regard, the transfer head conveyor 30 and the package feed conveyor 24 are both operated continuously at a set line speed, and are operated in such a fashion that each band transfer head 29/band forming head 37 assembly connected to the transfer head conveyor 30 will overlie a package tray 51 (and, therefor, a product package 11) in the banding station 31 of the banding machine 10, as particularly seen in FIG. 2. More particularly, a band 14 is initially picked up by vacuum pickup cup 107 on transfer arm 28 at the band supply source 27 from the band hopper 26. This band 14, which is in the form of a relatively long and relatively narrow sheet, is then transferred to vacuum head plate 35 of the band transfer head 29 while the transfer head conveyor 30 is in continuous motion. The transfer head 29 then carries the band 14 in clockwise motion as shown by motion arrow 139 in FIG. 2 past the glue station 44 where at least one dot 43 of glue is provided on the leading end flap 14*a* of the band, at least one glue dot is provided generally centrally of the band, and at least one glue dot is provided on the trailing end flap 14*b* of the band. The band 14, adhered by vacuum to the band transfer head 29, is then guided along curved guide rail 115 (to prevent premature deflection or creasing of the band) into juxtaposed proximity with a product package on one of the package conveyor's trays 51.

The band transfer head 29 is in assembly with the band forming head 37 which includes a follower roller 84 engageable with follower track section 85*a* at the in-feed or upstream end of the transfer head conveyor 30. It is the band forming head 37 (by virtue of its follower roller 84 being guided in follower track 85*a*) that holds the band forming head and the band transfer head 29 out of operative or forming relation with the package 11 until the appropriate position in the machine's banding machine station 31. This for the reason that the band transfer head's shaft 88 is telescopingly engaged through the band forming head's shaft 79 with the band transfer head's roller 90 stopping the band transfer head's extended or outward movement by contacting the band forming head's ported clamp 105. So when the follower track 85*a*, with the forming head's follower roller 84 captured in it, slopes in its downward section 85*b* as shown in FIG. 2, this causes the band transfer head 29 to drop so as to locate the band 14 in a central in-line machine direction MD alignment with the package 11, and causes the band flaps 14*a*, 14*b* to be deformed downwardly along the side edges 39 of the package 11 by the forming head's plates 81 into that configuration illustrated in FIGS. 2 and 3.

The band flap's leading 14*a* and trailing 14*b* ends in this left hand line 20 are then folded under the package 11 onto the package's reverse face 40 in an operational sequence which differs with that used for the right hand line 21 (compare FIGS. 6A–6D to FIGS. 5A–5D) which will be described in greater detail below. As each combined band transfer head 29/band forming head 37 assembly passes through the band wrapping station 31 of the machine 10, follower track sections 85, 86 oriented parallel to the package conveyor 24 cooperates with the follower roller 84 on the band forming head 37 to make sure that the band forming head 37 and band transfer head 29 are pushed down against the package 11 so as to ensure folding of the band appropriately about the side edges 39 of the package. As each band transfer head 29/band forming head 37 assembly moves out of the machine's banding station 31, the upwardly sloped follower track section 87 causes the band forming head 37 to move out of forming relation, i.e., to retract it above, the package 11 so that the fully banded package 11*c* (FIG. 2) can continue to move forward in the machine direction MD onto the outfeed conveyor 25. With each band transfer head 29/band forming head 37 assembly continuing to be moved by the transfer head conveyor 30 around the downstream end of that conveyor up onto the conveyor's upper run 30*b*, the band transfer head's roller 90 cooperates with axle drum 140 to guide the band transfer head's roller onto transfer head follower track 91 which extends beneath the transfer head conveyor's upper run 30*b*, and also parallel to the package conveyor 24. At this point, gravity holds the band forming head 37 in its retracted position relative to the band transfer head 29 as each such assembly traverses the upper run 30*b* of the transfer head conveyor 30 until, once again, the band transfer head plate 35 is provided with a new band by the band supply source's transfer arm 28 at which point the cycle begins anew.

The folding of a band's leading end flap 14*a*, 15*a* and trailing end flap 14*b*, 15*b*, as mentioned above, is provided in a different sequence depending on whether the package being banded is the left hand package 11 or the right hand package 12 of a two package combination as shown in FIG. 1. The left hand package 11 is banded in accord with flap folder mechanism 120 illustrated in FIGS. 2 and 6. This mechanism, in its operational sequence, ensures that the band's trailing flap 14*b* is folded first, and the band's leading flap 14*a* is folded second, in order to make sure that the UPC bar code at the band's leading end 14*a* is fully visible to a bar code reader. In this regard, and as shown in FIGS. 2 and 6A–6D, the second flap folder 42, i.e., the rollers 122 series, for folding the band's leading end flap 14*a* is stationary during band end 14*a*, 14*b* folding use and, indeed, is fixed to the machine frame 50 so it is stationary at all times. On the other hand, the first flap folder 41 for folding the band's trailing end flap 14*b* is in the form of a pair 125 of rollers on a flap folder conveyor 124 that operates with intermittent motion. The intermittent motion conveyor 124 is comprised of a stop cycle at which the roller pairs 125 are stationary and a fast advance cycle at which the roller pairs 125 move in a machine direction MD at a speed significantly greater than the set line speed of the package conveyor 24.

With regard to a description of this left hand band leading flap 14*a*/trailing flap 14*b* folding cycle illustrated in FIGS. 6A–6D, it will be remembered that the left hand packages 11 themselves are moving continuously at the set line speed on the package conveyor during the folding sequence of each band's leading 14*a* and trailing 14*b* flaps. More particularly, and with regard to FIG. 6A, package A is set to have its band's rear flap 14*b* folded first by a roller folder pair 125, this figure showing the start of the stop cycle of the band flap folding sequence. At this FIG. 6A location, the intermittent motion conveyor 124 is completely stopped but package A is moved from its FIG. 6A location to its FIG. 6B location while the intermittent motion conveyor is stopped because the package conveyor 24 continues to move at its set line speed. Upon reaching the FIG. 6B location, i.e., at the end of the stop cycle of the flap 14*a*, 14*b* folding sequence, roller pair A' advances very quickly (i.e., accelerates in the machine direction to a first fold speed or MD line speed significantly greater then the package conveyor's set line speed) so as to fold package A's trailing flap 14*b* inwardly against the package's reverse or under face 40 where it is held in place by a previously applied trailing flap glue spot 43. FIG. 6C shows the roller pair A' at an intermediate position in its quick advance cycle folding the band's trailing flap 14*b*, and FIG. 6D shows the location of that roller pair A' at the start of the next stop cycle that is, after the drive 130 has caused the intermittent motion conveyor 124 to decelerate the roller pair A' to a speed less than the line speed, with the band's trailing flap completely folded under package A. It will be noted in FIG. 6C that the prior package X has received (during this folding step for the trailing flap 14*b* on package A) a second pass by roller pair X' that served package X, thereby ensuring adherence of the band's trailing flap 14*b* to the package X. As shown in FIG. 6D, subsequent continuous motion of package X on the package conveyor 24 will bring it to the position as shown. In this position, the package passes over the roller 122 group 42 (which is stationary relative to the package conveyor 24) so that the band's leading flap 14*a* also will be folded against the package's reverse or under face 40 into proper overlapping relation with the band's trailing flap 14*b*. This sequence, therefor, provides a band 14 wrapped around the package 11 in accord with the left hand package illustrated in FIG. 1.

The band leading 15*a* and trailing 15*b* flap folding sequence for the right hand process line 21 is illustrated in FIGS. 5A–5D. In this method sequence, the flap folder conveyor 133 is also an intermittent motion conveyor. This particular intermittent motion conveyor is provided with a first folder 131 comprised of roller pair 1, 2, and a second flap folder 132 comprised of roller pair 3,4. The roller pair 1, 2 functions to fold trailing flap 15*b* of the band 15 against the package's reverse face 40, and the roller pair 3, 4 functions to fold the band's leading flap 15*a* against the package's reverse face, all while the package 12 is moving in the machine direction MD. In other words, both the first 131 and second 132 flap folders are connected with the intermittent motion conveyor 133 in this right hand flap folding system, whereas in the FIGS. 6A–6D flap folding system only the second flap folder 42 is connected to intermittent motion conveyor 45. So with this FIGS. 5A–5D flap folding system, the band's leading flap **15*a* for package A is folded before the band's trailing flap 15*b*** for package A.

In this right hand line 21, the intermittent motion conveyor 133 presents a stop cycle and a quick advance cycle, just as with the intermittent motion conveyor 124 described in connection with FIGS. 6A–6D. The start of the stop cycle is shown in FIG. 5A and the end of the stop cycle is shown in FIG. 5B, the rollers 1–4 of group X' being held stationary during this stop cycle while the package conveyor 24 continues to move at the set line speed. As the package conveyor 24 so moves, and with the roller group X' being stationary, the band's leading flap **15*a* on package A is folded into banded relation with the package's reverse face 40 as shown in FIG. 5B through contact with rollers 3, 4 of prior roller group X'. At this point, drive 130 causes the intermittent motion conveyor 133 to start its fast advance cycle by accelerating rollers 1, 2, 3, 4 of roller group A' to a first fold speed in the machine direction MD, that is, a faster line speed then the package conveyor's set line speed in order to fold under the band's trailing flap 15*b* for package A. The position of the roller group A' is shown intermediate its cycle in FIG. 5C, and the position of roller group A' is shown at the end of its stroke in FIG. 5D where package A has had its rear flap 15*b* sealed to the package's reverse face 40 in accord with the right hand package 12 as shown in FIG. 1. At this end of the quick advance cycle shown in FIG. 5D, the drive 130 causes the intermittent motion conveyor 133 to decelerate the rollers 1,2,3,4 of roller group A' to a second fold speed less than the line speed and start the stop cycle so that the rollers 3, 4 of roller group A' are now in a stationary position to close the band's leading flap 15*a* of trailing package B. Note particularly in this step sequence that at least two more passes of the package A will be provided by roller groups X' and A' as package A continues to move along the intermittent motion conveyor 133 from its upstream end to its downstream end, thereby ensuring that each band's leading 15*a* and trailing 15*b* flaps will be suitably adhered to the package's reverse face 40**.

Having described in detail the preferred embodiment of our invention, what we desire to claim and protect by Letters Patent is:

1. A method of wrapping a band around a package comprising the steps of:

moving said package in a machine direction at a line speed;

moving said band in said machine direction at said line speed, said band having leading and trailing ends relative to said machine direction;

partially wrapping said band around said package, relative to said machine direction said partially wrapped band presenting a leading flap formed from said leading end of said band and a trailing flap formed from said trailing end of said band;

accelerating a first flap folder in said machine direction to a first fold speed greater than said line speed, said acceleration step causing said trailing flap to be folded against said package; and decelerating said first flap folder to a second fold speed less than said line speed, said deceleration step allowing said leading flap to be folded against said package.

2. The method of claim 1 comprising:

said folding of said trailing flap against said package occurring in response to accelerating said first flap folder; and thereafter said folding of said leading flap against said package occurring in response to decelerating said first flap folder.

3. The method of claim 2 comprising:

folding said trailing flap in said machine direction with said first flap folder in response to accelerating said first flap folder to bring said trailing flap into wrapped contact with said package; and thereafter folding said leading flap in an opposite direction to said machine direction while said first flap folder is at said second fold speed to bring said leading flap into wrapped contact with said package.

4. The method of claim 3 comprising:

providing indicia on said leading flap, and folding said leading flap having said indicia after folding said trailing flap so that said indicia on said leading flap is unobstructed by said trailing flap when both said leading and trailing flaps are in final wrapped contact with said package.

5. The method of claim 4 comprising folding said leading flap with a second flap folder in response to moving said band and said package in said machine direction.

6. The method of claim 5 comprising maintaining said second flap folder generally stationary to establish said second fold speed while moving said band and said package in said machine direction.

7. The method of claim 6 comprising fixing said second flap folder in said stationary position relative to said machine direction.

8. The method of claim 1 comprising:

said folding of said leading flap against said package occurring in response to decelerating said first flap folder; and thereafter said folding of said trailing flap against said package occurring in response to accelerating said first flap folder.

9. The method of claim 8 comprising:

folding said leading flap in a direction opposite to said machine direction while said first flap folder is at said second fold speed for bringing said leading flap into wrapped contact with said package; and thereafter folding said trailing flap in said machine direction with said first flap folder in response to accelerating said first flap folder for bringing said trailing flap into wrapped contact with said package.

10. The method of claim 9 comprising providing indicia on said trailing flap, and folding said trailing flap having said indicia after folding said leading flap so that said indicia on said trailing flap is unobstructed by said leading flap when both said leading and trailing flaps are in final wrapped contact with said package.

11. The method of claim 10 comprising folding said leading flap with a second flap folder in response to moving said band and said package in said machine direction.

12. The method of claim 11 comprising maintaining said second flap folder generally stationary to establish said second fold speed while moving said band and said package in said machine direction.

13. The method of claim 12 comprising moving said second flap folder in unison with said first flap folder as said trailing flap is folded against said package with said first flap folder when said first and said second flap folders are moving at said first fold speed.

14. A method of simultaneously wrapping two bands around two packages comprising the steps of:

moving both said packages in a machine direction at a line speed;

moving both said bands in said machine direction at said line speed, each of said bands having leading and trailing ends relative to said machine direction;

partially wrapping both said bands around said packages, relative to said machine direction each of said partially wrapped bands presenting a leading flap formed from said leading end of said band and a trailing flap formed from said trailing end of said band;

as to one of said packages and its band, conveying said package in said machine direction past a first flap folder to fold first said leading flap of said band into wrapped contact with said package, thereby first folding said leading flap in a counter machine direction relative to said package direction, and thereafter accelerating a second flap folder in said machine direction to a fold speed greater than said line speed to fold second said trailing flap of said band into wrapped contact with said package, thereby folding second said trailing flap in said machine direction relative to said package direction; and as to the other of said packages and its band, accelerating a third flap folder in said machine direction to a fold speed greater than said line speed to fold first said trailing flap of said band into wrapped contact with said package, thereby first folding said trailing flap in said machine direction relative to said package direction, and thereafter conveying said package in said machine direction past a fourth flap folder to fold second said leading flap of said band into wrapped contact with said package, thereby folding second said leading flap in a counter machine direction relative to said package direction.

15. The method of claim 14 comprising accelerating simultaneously said second and third flap folders to a first fold speed greater than said line speed.

16. The method of claim 15 comprising moving said first, said second and said third flap folders in unison.

17. A method of simultaneously wrapping bands around packages comprising the steps of:

moving first and second packages in a machine direction at a line speed;

moving first and second unwrapped bands in said machine direction at said line speed, each of said unwrapped bands having leading and trailing ends relative to said machine direction with indicia on one of said leading and said trailing ends;

partially wrapping said first and said second unwrapped bands around said first and said second packages, respectively, relative to said machine direction, said first band presenting a leading flap formed from said leading end of said band and a trailing flap formed from said trailing end of said band, and said second band presenting a trailing flap formed from said trailing end of said band and a leading flap formed from said leading end of said band, said first band having indicia on said leading flap and said second band having indicia on said trailing flap;

folding said leading and said trailing flaps of said first band in a first sequence against said first package so that said indicia on said leading flap of said first band is unobstructed by said trailing flap of said first band; and folding said leading and said trailing flaps of said second band in a second different sequence against said second package so that said indicia on said trailing flap of said second band is unobstructed by said leading flap of said second band, said first and said second folding sequences being different one from the other because of the different orientations of said indicia on said first and second bands relative to said packages.

18. The method of claim 17 comprising:

folding said trailing flap of said first band against said first package; and thereafter folding said leading flap of said first band against said first package so as to overlap said trailing flap of said first band.

19. The method of claim 18 comprising:

folding said leading flap of said second band against said second package; and thereafter folding said trailing flap of said second band against said second package so as to overlap said leading flap of said second band.

20. The method of claim 14 comprising folding said leading flap of said first band, and folding said trailing flap of said second band, substantially simultaneously.

21. A package banding machine for wrapping a package with a band, said machine comprising:

a package conveyor for moving said package in a machine direction at a line speed;

a band transfer head mounted to a head conveyor, said transfer head being operable to position said band against a first surface of said package, said band having leading and trailing ends relative to said machine direction;

a band forming head reciprocally mounted relative to said band transfer head on said head conveyor, said band forming head being operable to partially wrap said band around said package, and relative to said machine direction said partially wrapped band presenting a leading flap formed from said leading end of said band and a trailing flap formed from said trailing end of said band; and a flap folder adapted to cyclically accelerate to a first fold speed greater than said line speed and decelerate to a second fold speed less than said line speed, said flap folder having a first folding device contacting said trailing flap in response to acceleration of said flap folder to said first fold speed to move said trailing flap in said machine direction and wrap said trailing flap against said package; and a second folding device contacting said leading flap in response to deceleration of said flap folder to said second fold speed to move said leading flap in a direction opposite said machine direction and wrap said leading flap against said package.

22. The package banding machine of claim 21 comprising:

a flap folding conveyor having a plurality of sets of said first and said second flap folding devices, said sets being spaced over a length of said flap folding conveyor.

23. The package banding machine of claim 22 having said second flap folding device positioned forward of said first flap folding device with respect to said machine direction within each set of said plurality of sets of said first and said second flap folding devices.

24. The package banding machine of claim 23 comprising:

a drive operatively connected to said flap folding conveyor for providing intermittent cycles of operation of said flap folding conveyor, said drive causing said flap folding conveyor to accelerate to said first fold speed and said flap folding conveyor to decelerate to said second fold speed.

25. The package banding machine of claim 20, said drive comprising a stop cycle control for stopping said flap folding conveyor at a stationary position to permit said leading flap to contact and be folded by said second folding device, and a fast advance cycle control for accelerating said flap folding conveyor to said first fold speed to permit said first flap folding device to contact and to fold said trailing flap.

26. A package banding machine for wrapping a package with a band, said machine comprising:

a package conveyor for moving said package in a machine direction at a set line speed;

a head conveyor mounted above said package conveyor;

a band transfer head mounted to said head conveyor, said transfer head being operable to position said band against a first surface of said package;

a band forming head mounted on said head conveyor to have a reciprocating motion relative to said band transfer head, said band forming head being operable to deform said band around and against opposed side faces of said package;

a first guide track cooperable with said transfer head, said first guide track orienting said transfer head in a position where said band can be received thereon, and said first guide track permitting said forming head to move generally vertically into a retracted position relative to said transfer head so that said band can be loaded onto said transfer head without interference from said forming head; and a second guide track cooperable with said forming head, said second guide track permitting said transfer head to position said band against said first surface of said package, and said second guide track being adapted to guide said forming head downward into a forming relation with said band after said transfer head has positioned said band against said package so that said band can be formed around and against said opposed side faces of said package.

27. The package banding machine of claim 26, said first guide track is structured so that said transfer head is moved to a position for accepting one of said bands.

28. The package banding machine of claim 27, said first guide track being structured so that said forming head is permitted to move to its retracted position in response to gravity, thereby permitting said transfer head to receive said band without interference from said forming head.

29. The package banding machine of claim 26, said second guide track being structured so that said forming head operates in response to gravity in forming said band.

30. The package banding machine of claim 29, said second guide track being structured so that said transfer head is permitted to move said band into contact against said first surface of said package in response to gravity.

31. An apparatus for simultaneously wrapping bands around ends of a package comprising the steps of:

a package conveyor for moving a package in a machine direction at a line speed;

a source for unwrapped bands, each of said unwrapped bands having leading and trailing ends relative to said machine direction with indicia on one of said leading and trailing ends;

a band transfer head conveyor proximate said source of unwrapped bands and having at least first and second band transfer heads for receiving unwrapped first and second bands from said source, said transfer head conveyor being moveable with respect to said package conveyor to position said first transfer head adjacent a package so that indicia is presented on said leading end of said first band, and to position said second transfer head adjacent said package so that indicia is presented on said trailing end of said second band;

first and second band forming heads mounted on said transfer head conveyor for reciprocal motion with respect to said first and said second transfer heads, respectively, for partially wrapping said first and said second bands over sides of said package to form leading and trailing flaps from said leading and trailing ends, respectively, of said first and said second bands so that said indicia is on a leading flap of said first band and said indicia is on a trailing flap of said second band;

a first flap folding mechanism for folding said leading and trailing flaps of said first band in a first sequence against said package so that said indicia on said leading flap of said first band is unobstructed by said trailing flap of said first band; and a second flap folding mechanism for folding said leading and trailing flaps of said second band in a different second sequence against said package so that said indicia on said trailing flap is unobstructed by said leading flap of said second band, said first and said second folding sequences being different one from the other in view of the different orientations of said indicia on said first and second bands relative to said package.

32. The apparatus of claim 31, said first flap folding mechanism comprising:

a first flap folder for folding said trailing flap of said first band against said package; and a second flap folder for folding said leading flap of said first band against said package.

33. The apparatus of claim 22, said second flap folding mechanism comprising:

a third flap folder for folding said leading flap of said second band against said package; and a fourth flap folder for folding said trailing flap of said second band against said package.

34. The apparatus of claim 33, said first, said second, and said third fourth flap folders being mounted on a flap folder conveyor operating intermittently relative to said package conveyor to cause said second and said third flap folders to fold simultaneously said trailing flap of said first band and said leading flap of said second band.

35. The apparatus of claim 34, said fourth flap folder being maintained in a fixed stationary position.

* * * * *

UNITED STATES PATENT AND TRADEMARK OFFICE

CERTIFICATE OF CORRECTION

PATENT NO. : 5,452,561

DATED : September 26, 1995

INVENTOR(S) : Ralph F. Thompson and Charles E. Frost

It is certified that error appears in the above-identified patent and that said Letters Patent is hereby corrected as shown below:

At Column 2, line 49 please delete "5" and insert in its place -- 5A --.

At Column 10, line 36 please delete "21" and insert in its place -- 121 --.

At Column 16, line 39 please delete "14" and insert in its place -- 19 --.

At Column 17, line 28 please delete "20" and insert in its place -- 24 --.

At Column 18, line 66 please delete "22" and insert in its place -- 32 --.

Signed and Sealed this

Ninth Day of July, 1996

*Attest:*

Bruce Lehman

BRUCE LEHMAN

*Attesting Officer*

*Commissioner of Patents and Trademarks*